US006600301B1

(12) United States Patent
DeFalco

(10) Patent No.: US 6,600,301 B1
(45) Date of Patent: Jul. 29, 2003

(54) CURRENT SHUTDOWN CIRCUIT FOR ACTIVE BIAS CIRCUIT HAVING PROCESS VARIATION COMPENSATION

(75) Inventor: John A. DeFalco, Marlborough, MA (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 10/135,719

(22) Filed: Apr. 30, 2002

(51) Int. Cl.[7] ..... G05F 3/04
(52) U.S. Cl. ..... 323/312; 327/543
(58) Field of Search ..... 323/312, 313, 323/314; 327/530, 538, 540, 541, 543

(56) References Cited

U.S. PATENT DOCUMENTS

| | | | | |
|---|---|---|---|---|
| 5,483,150 A | * | 1/1996 | Elliott et al. | 323/312 |
| 5,793,194 A | | 8/1998 | Lewis | 323/312 |
| 5,977,759 A | * | 11/1999 | Stich | 323/313 |
| 6,175,267 B1 | * | 1/2001 | Bree et al. | 327/541 |

* cited by examiner

*Primary Examiner*—Jessica Han
(74) *Attorney, Agent, or Firm*—Daly, Crowley & Mofford, LLP

(57) ABSTRACT

An integrated circuit biasing network for producing .a.predetermined level of bias current. The bias network includes a field-effect transistor having a gate, a source and a drain. The transistor produces a level of bias current corresponding to a predetermined input gate-source voltage applied to the field effect transistor. A control circuit is provided. The control circuit is connected to the field effect transistor and provides a current through a control current path to produce the field effect transistor input voltage. A compensation circuit is connected to the control circuit. The compensation circuit includes a compensation transistor of the same type as the field effect transistor. The compensation circuit operates the compensation transistor to divert current from said control path whereby process variations cause the compensation transistor to draw a current of a magnitude to provide an input voltage to the field effect transistor to enable such field effect transistor to produce said predetermined level of bias current. A transistor switch is provided having a first and second electrode. Conductivity between such first and second electrodes is controlled by an "on"/"off" control signal fed to a control electrode of such transistor switch. One of such first and second electrodes is coupled to the gate of the field effect transistor and the other one of the first and second electrodes is coupled to a predetermined reference potential. The transistor switch is placed in a conductive condition by the "on"/"off " control signal to couple the gate of the field effect transistor to such reference potential during an "off" condition of the control signal. Such coupling to the reference potential turns the field effect transistor to a non-conducting state during such "off" condition. The transistor switch is placed in a non-conductive condition to de-couple the gate of the field effect transistor from such reference potential during an "on" condition of the control signal to enable the field effect transistor to amplify a signal fed to the gate thereof during such "on" condition. The reference potential is coupled to the control circuit. The field effect transistor, the compensation transistor and the transistor switch are depletion mode field effect transistors. The compensation circuit is coupled between a second reference potential and the first-mentioned reference potential.

4 Claims, 1 Drawing Sheet

CURRENT SHUTDOWN CIRCUIT FOR ACTIVE BIAS CIRCUIT HAVING PROCESS VARIATION COMPENSATION

TECHNICAL FIELD

This invention relates to active bias circuits.

BACKGROUND

As is known in the art, active bias circuits have a wide range of applications. One such active bias circuit is described in U.S. Pat. No. 5,793,194 entitled "Bias Circuit Having Process Variation Compensation and Power Supply Variation Compensation", inventor Edward T. Lewis, issued Aug. 11, 1998, assigned to the same assignee as the present application, the entire subject matter thereof being incorporated herein by reference. Some of these applications include battery-operated cellular telephones and wireless Local Area Networks (WLANS). More particularly, the bias circuit may be used to supply bias current to transmitter and receiver amplifiers used therein.

As also known in the art, in battery operated cellular telephone and wireless Local Area Networks (WLANS) applications, it is frequently desirable to reduce the power in the transmitter amplifier when the phone is in the receive mode. One technique suggested to provide such power reduction is to place a transistor switch in series with VDD and the drain of the RF amplifying transistor. Power is saved by decoupling VDD from the drain of the RF amplifying transistor. This has several major disadvantages however. While the transistor switch being in series with the RF transistor must be in a conducting mode during the desired amplification. When such transistor switch is conducting a voltage drop is produced across such transistor switch thereby reducing amplification power. Further, the transistor switch requires additional components to bias the switch and extra logic to turn it off. Also, the drain of the RF transistor requires it to be bypassed with very large capacitors. Thus, if switching is performed at this point in the circuit, one must charge and discharge these capacitors (when turning on and off the transistor switch). Such charging and discharging however requires time, in the order of tens on microseconds. Applications, such as wireless Local Area Networks (WLANS) require this switching action to take place in under a microsecond.

SUMMARY

In accordance with the invention, an integrated circuit biasing network is provided for producing a predetermined level of bias current. The bias network includes a field-effect transistor having a gate, a source and a drain. The transistor produces a level of bias current corresponding to a predetermined input gate-source voltage applied to the field effect transistor. A control circuit is provided. The control circuit is connected to the field effect transistor and provides a current through a control current path to produce the field effect transistor input voltage. A compensation circuit is connected to the control circuit. The compensation circuit includes a compensation transistor of the same type as the field effect transistor. The compensation circuit operates the compensation transistor to divert current from said control current path whereby process variations cause the compensation transistor to draw a current of a magnitude to provide an input voltage to the field effect transistor to enable such field effect transistor to produce said predetermined level of bias current. A transistor switch is provided having a first and second electrode. Conductivity between such first and second electrodes is controlled by an "on"/"off" control signal fed to a control electrode of such transistor switch. One of such first and second electrodes is coupled to the gate of the field effect transistor and the other one of the first and second electrodes is coupled to a predetermined reference potential. The transistor switch is placed in a conduction condition by the "on"/"off" control signal to couple the gate of the field effect transistor to such reference potential during an "off" condition of the control signal. Such coupling to the reference potential turns the field effect transistor to a non-conducting state during such "off" condition. The transistor switch is placed in a non-conductive condition to decouple the gate of the field effect transistor from such reference potential during an "on" condition of the control signal to enable the field effect transistor to amplify a signal fed to the gate thereof during such "on" condition.

With such an arrangement, the turn off circuit is at the RF gate, which do not require as much bypassing. Therefore, the arrangement is able to turn of the RF transmitter within the 1 microsecond requirement.

In one embodiment, the reference potential is coupled to the control circuit.

In one embodiment, the field effect transistor, the compensation transistor and the transistor switch are depletion mode field effect transistors.

In one embodiment, the compensation circuit is coupled between a second reference potential and the first-mentioned reference potential.

The details of one or more embodiments of the invention are set forth in the accompanying drawings and the description below. Other features, objects, and advantages of the invention will be apparent from the description and drawings, and from the claims.

DESCRIPTION OF DRAWING

The single FIGURE is a schematic diagram of a microwave amplifier having a process variation compensated active bias circuit with a shutdown circuit according to the invention.

DETAILED DESCRIPTION

Figure 1:
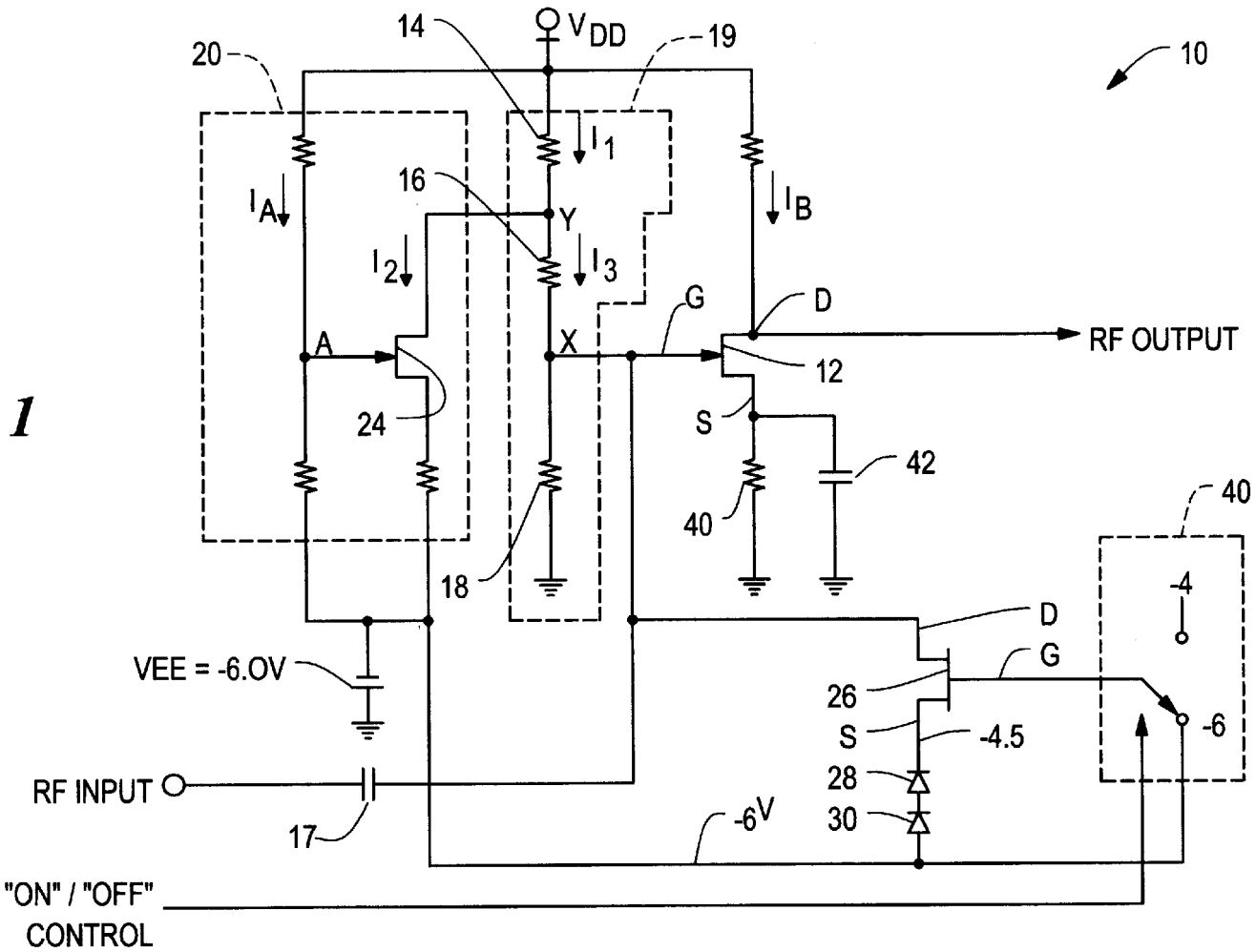

Referring now to the FIGURE, an integrated circuit biasing network 10 is shown for producing a predetermined level of bias current, $I_B$. The biasing network 10 includes a field-effect transistor (FET) 12 having a gate (G), a source (S) and a drain (D). The transistor 12 here a depletion mode field effect transistor (DFET) produces a level of bias current through the source (S) and drain (D) thereof corresponding to a predetermined input gate-source voltage applied to the field effect transistor 12. A control circuit 19 comprising resistors 14, 16 and 18 serially connected between VDD and ground is provided. The control circuit 19 is connected to the field effect transistor 12 and provides a current $I_3$ through a control current path (i.e., through resistors 14, 16 and 18) to produce the field effect transistor 12 input voltage X at the gate (G) of such transistor 12.

A compensation circuit 20 is connected to the control circuit. The compensation circuit 20 includes a compensation transistor 24 of the same type as the field effect transistor 12. The compensation circuit 20 operates the compensation transistor 24 to divert current $I_1$ from said control path whereby process variations cause the compensation transistor 24 to draw a current of a magnitude to provide an input voltage, X, to the field effect transistor 12 to enable such field effect transistor 12 to produce said predetermined level of bias current $I_B$.

A transistor switch 26, here a depletion mode transistor, is provided having source (S) and drain (D) electrodes. The drain (D) of transistor switch 26 is coupled to the gate (G) of the field effect transistor 12 and the source (S) of transistor switch 26 is coupled to a predetermined reference potential. Conductivity between such source (S) and drain (D) electrodes is controlled by an "on"/"off" control signal fed to the gate (G) electrode of such transistor switch 26. In the following discussion, the terms on/off will refer to the conduction state of the RF transistor 12. The transistor switch 26 is placed in a conductive condition by the "on"/"off" control signal to couple the gate of the field effect transistor 12 to such reference potential during an "off" condition of the control signal. Such coupling to the reference potential turns the field effect transistor 12 to a non-conducting state during such "off" condition. The transistor switch 26 is placed in a non-conductive condition to de-couple the gate (G) of the field effect transistor 12 from such reference potential during an "on" condition of the control signal to enable the field effect transistor 12 to amplify an RF signal fed to the gate (G) thereof via an ac coupling capacitor 17 during such "on" condition.

With such an arrangement, the transistor switch 26 is at the gate (G) of transistor 12 and such transistor switch is non-conducting when the RF signal is amplified by the transistor 12. Therefore, power consumption is reduced. Further, with such an the arrangement, the RF amplifier is able to be turned off within 1 microseconds.

More particularly, the resistor values of resistors 14, 16 and 18 are selected to provide a suitable control voltage at the gate G of DFET 12.

As will be understood by those skilled in the art, in a depletion mode FET, the gate-source voltage must be negative in polarity in order to establish a drain-source current. This maybe accomplished by two techniques. In one method, a resistor 40 is connected between source S of DFET 12 and ground. The voltage drop across this resistor 40 provides a positive voltage at the source S that is greater than the gate potential, thus providing the desired gate-source polarity. It may also be preferred to provide a bypass capacitor 42 for those applications where DFET 12 is an active input transistor to another device (not shown). Alternately, resistor 40 and capacitor 42 may be eliminated and the source of transistor 12 grounded. The networks, 20 and 19 are then designed to produce the necessary negative voltage at point X by letting current 12 be sufficiently high so that a net negative voltage is produced at point X. This embodiment has the advantage of eliminating two components (40,42) and providing maximum power out of transistor 12 since no D.C. voltage drop appears at its source.

As noted, the bias current, $I_B$, provided by biasing transistor 12 varies considerably with process variations, particularly those affecting the device threshold voltage. Variations in the power supply to the biasing circuit will also affect the bias current.

Process variation compensation is provided by circuits 19 and 20. The depletion mode field-effect transistor 24 is made on the same chip as DFET 12 and thus is subject to the same process variations as DFET 12.

In operation, assume that the actual device threshold voltage of the transistors in the circuit is such that the bias current of DFET 12 would tend to be greater than expected. In order to maintain a constant bias current $I_B$ at the drain of DFET 12, the voltage at the gate (G) of DFET 12 must be reduced. Otherwise, as noted, the bias current may be greater than expected design specifications.

In such a case, the drain current $I_2$ of DFET 24 is also greater because its device threshold voltage is affected by the same process variation as that affecting DFET 12. DFET 24 thus draws more current at node Y. As a result, the current 13 is reduced. This, in turn, reduces the voltage at node X, i.e., the gate voltage of DFET 12. This results in the bias current $I_B$ being maintained at the specified design level, instead of a deviation in $I_B$ which would otherwise have existed due to the process variation.

Transistor switch 26 has its source (S) at −4.5 volts. More particularly, a −6.0 volt potential is at the low potential side of circuit 20. The −6.0 volt potential is coupled to the source (S) of transistor switch 26 through a pair of serially connected diodes 28, 30 to thereby provide the −4.5 volts at the source (S) of transistor switch 26. Logic 40 from input on or off the chip provides the proper (i.e., more positive than the pinch off voltage of transistor switch 26 and the −4.5 source (S) voltage for transistor switch 26), typically −4.0 volts to turn transistor switch 26 on. The physical size (i.e., channel width and length) of transistor switch 26 are selected to sink the current 13. This insures that the voltage at the gate (G) of transistor 12 is more negative than the pinch off voltage of transistor 12. This turns transistor 12 off and saves battery current.

In operation, when the "on"/"off" control signal selects the condition to enable amplification of the RF signal, transistor switch 26 has the gate (G) thereof coupled to −6.0 volts and transistor switch 26 is driven "off". In such condition, the RF signal is amplified by transistor 12. On the other hand, when the "on"/"off" control signal selects the condition tow disable amplification of the RF signal, transistor switch 26 has the gate (G) thereof coupled to −4 volts and transistor switch 26 is turned "on". In such condition, the transistor 12 is driven "off".

A number of embodiments of the invention have been described. Nevertheless, it will be understood that various modifications may be made without departing from the spirit and scope of the invention. Accordingly, other embodiments are within the scope of the following claims.

What is claimed is:

1. An integrated circuit for a bias network for producing a predetermined level of bias current, said bias network comprising:

(A) a field-effect transistor having a gate, a source and a drain, said transistor producing a level of bias current corresponding to a predetermined input gate-source voltage applied to said transistor;

(B) a control circuit connected to the field effect transistor for providing a current through a control current path to produce the field effect transistor input gate-source voltage;

(C) a compensation circuit connected to said control circuit, said compensating circuit including a compensation transistor of the same type as the field effect transistor, wherein said compensation circuit operates the compensation transistor to change current from said control path whereby process variations cause the compensation transistor to draw a current of a magnitude to provide an input gate-source voltage to the field effect transistor to enable such field effect transistor to produce said predetermined level of bias current; and (D) a transistor switch having a first and second electrode, conductivity between such first and second electrodes being controlled by an on/off control signal fed to a control electrode of such transistor switch, one of such first and second electrodes being coupled to the gate of the field effect transistor and the other one of the first and second electrodes being coupled to a predetermined reference potential, such transistor switch being placed in a conductive condition to couple the gate of the field effect transistor to such reference potential during an off condition of the control signal, such reference potential turning the field effect transistor to a non-conducting state during an "off" condition, such transistor switch being placed in a non-conductive condition to de-couple the gate of the field effect transistor from such reference potential during an on condition of the control signal to enable the field effect transistor to amplify a signal fed to the gate thereof during such "on" condition.

2. The integrated circuit recited in claim 1 wherein the reference potential is coupled to the control means.

3. The integrated circuit recited in claim 2 wherein the field effect transistor, the compensation transistor and the switch transistor are depletion mode field effect transistors.

4. The integrated circuit recited in claim 3 wherein the compensation circuit is coupled between a second reference potential and the first-mentioned reference potential.

* * * * *

UNITED STATES PATENT AND TRADEMARK OFFICE

CERTIFICATE OF CORRECTION

PATENT NO. : 6,600,301 B1
DATED : July 29, 2003
INVENTOR(S) : John A. DeFalco

It is certified that error appears in the above-identified patent and that said Letters Patent is hereby corrected as shown below:

Title page,
Item [57], ABSTRACT,
Line 1, delete ".a." and replace with -- a --.
Lines 6, 7, 9, 11, 16, 17, 23, 27, 29, 32, 34, 36-37 and 38, delete "field effect" and replace with -- field-effect --.

Column 1,
Line 22, delete "battery operated" and replace with -- battery-operated --.
Line 34, delete "is conducting a" and replace with -- is conducting, a --.
Lines 54, 56, 57, 60 and 65, delete "field effect" and replace with -- field-effect --.

Column 2,
Lines 5, 8-9, 56, 58, 62 and 67, delete "field effect" and replace with -- field-effect --.
Lines 14, 16, 27, 50 and 53, delete "field effect" and replace with -- field effect --.
Line 19, delete "which do not" and replace with -- which does not --.
Line 20, delete "turn of the" and replace with -- turn off the --.
Line 32, delete "accompanying drawings" and replace with -- accompanying drawing --.
Line 35, delete "drawings" and replace with -- drawing --.
Line 49, delete "The Transistor 12 here" and replace with -- The Transistor 12 here is --.
Line 50, delete "produces" and replace with -- that produces --.

Column 3,
Lines 1, 6, 14, 20 and 22, delete "field effect" and replace with -- field-effect --.
Line 30, delete "microseconds" and replace with -- microsecond --.

Column 4,
Lines 7 and 23, delete "13" and replace with -- $I_3$ --.
Line 33, delete "tow" and replace with -- to --.
Lines 51, 53, 57, 62 and 63, delete "field effect" and replace with -- field-effect --.

Column 5,
Lines 3, 7, 9 and 12, delete "field effect" and replace with -- field-effect --.

UNITED STATES PATENT AND TRADEMARK OFFICE

CERTIFICATE OF CORRECTION

PATENT NO. : 6,600,301 B1
DATED : July 29, 2003
INVENTOR(S) : John A. DeFalco

It is certified that error appears in the above-identified patent and that said Letters Patent is hereby corrected as shown below:

Column 6,
Lines 1, 7 and 8, delete "field effect" and replace with -- field-effect --.

Signed and Sealed this

Twenty-first Day of October, 2003

JAMES E. ROGAN
*Director of the United States Patent and Trademark Office*